US012102206B2

(12) United States Patent
Deng

(10) Patent No.: US 12,102,206 B2
(45) Date of Patent: Oct. 1, 2024

(54) DECORATIVE NAIL TIP AND MANUFACTURING SYSTEM AND METHOD THEREOF

(71) Applicant: SHANGHAI HUIZI COSMETICS CO., LTD., Shanghai (CN)

(72) Inventor: Jingbiao Deng, Shanghai (CN)

(73) Assignee: SHANGHAI HUIZI COSMETICS CO., LTD., Shanghai (CN)

( * ) Notice: Subject to any disclaimer, the term of this patent is extended or adjusted under 35 U.S.C. 154(b) by 0 days.

(21) Appl. No.: 18/174,807

(22) Filed: Feb. 27, 2023

(65) Prior Publication Data

US 2024/0251926 A1 Aug. 1, 2024

Related U.S. Application Data

(63) Continuation of application No. PCT/CN2023/073977, filed on Jan. 31, 2023.

(51) Int. Cl.
*A45D 29/00* (2006.01)
*A45D 31/00* (2006.01)

(52) U.S. Cl.
CPC ..... *A45D 31/00* (2013.01)

(58) Field of Classification Search
CPC ..... A45D 31/00; A45D 2031/005
See application file for complete search history.

(56) References Cited

U.S. PATENT DOCUMENTS

2013/0220355 A1* 8/2013 Park ..... A45D 29/001 132/73
2022/0133013 A1* 5/2022 Lotti ..... A45D 31/00
2022/0312930 A1 10/2022 Kim et al.
2023/0008814 A1 1/2023 Kim et al.

FOREIGN PATENT DOCUMENTS

CN 102137603 A 7/2011
CN 203873208 U 10/2014
JP 2004-254877 A 9/2004
KR 10-2013-000788 A 1/2013

OTHER PUBLICATIONS

International Search Report and Written Opinion, issued in the corresponding PCT application No. PCT/CN2023/073977, dated Jun. 11, 2023, 9 pages.

* cited by examiner

*Primary Examiner* — Rachel R Steitz
(74) *Attorney, Agent, or Firm* — HSML P. C.

(57) ABSTRACT

Provided are a decorative nail tip and a manufacturing system and method thereof. The decorative nail tip includes a nail tip layer shaped like a nail. A convex outer surface of the nail tip layer is a decorative surface. The nail tip layer includes a flexible portion and a rigid portion which are sequentially arranged in a nail tip direction. The decorative nail tip has a flexible end and a rigid end, and thus can fit the nail and has an orientation function. During use, the decorative nail tip can fit the edge of the nail by means of its flexibility, such that the possibility of stretching, folds, air holes, hollows and edge warping is reduced; and after being cured, the whole nail tip layer can decorate the nail in a rigid and plump form.

19 Claims, 2 Drawing Sheets

DECORATIVE NAIL TIP AND MANUFACTURING SYSTEM AND METHOD THEREOF

FIELD OF THE INVENTION

The present invention application relates to the field of manicure, and more particularly, relates to a nail tip and a manufacturing system and method thereof.

BACKGROUND OF THE INVENTION

Existing decorative nail tips have colors and/or patterns. The inner surface of decorative nail tips is adhered to human's fingernails or toenails (collectively referred to as "nails" hereinafter), and the outer surface of the decorative nail tips decorates and beautifies nails with its smooth, colored and/or patterned appearance.

However, due to the fact that the surface of human's nails is curved to different degrees, rigid nail tips cannot fit the nails and may fall from the nails due to hollowing or edge warping. In addition, a rigid nail tip layer is prone to warping from the periphery, which may hook user's hairs and cause dirt accumulation, thus failing to meet the manicure requirements of those who care about their beauty.

To solve the above technical problems, there is an urgent need for a novel decorative nail tip, the whole, especially the edge, of which can perfectly fit nails.

SUMMARY OF THE INVENTION

In one aspect, the present application provides a decorative nail tip, comprising a nail tip layer shaped like a nail, and a convex outer surface of the nail tip layer is a decorative layer. The nail tip layer comprises a flexible portion and a rigid portion which are sequentially arranged in a nail tip direction, an outer surface of the flexible portion and an outer surface of the rigid portion are in smooth transition to form the decorative surface, raw materials of the nail tip layer comprise a curing material, the curing material in the flexible portion is not cured, thus being flexible and stretchable, and the curing material in the rigid portion is cured, thus being rigid.

Further, preferably, a thickness of the flexible portion connected to the rigid portion decreases gradually towards an edge of the flexible portion not connected to the rigid portion.

Further, preferably, the flexible portion encircles an edge of the rigid portion in a U-shape.

Further, preferably, the content of the curing material in the raw materials of an edge of the flexible portion not connected to the rigid portion is lower than the content of the curing material in the raw materials of an edge of the flexible portion connected to the rigid portion.

Further, preferably, before being cured, the flexible portion has a shore hardness of 20 A-60 A, a stretch factor of 1.50-5.00 and a tensile strength of 80 MPa-500 Mpa;

After being cured, the flexible portion has a shore hardness of 20 D-70 D, a stretch factor of 1.05-1.20 and a tensile strength of 100 MPa-200 Mpa;

The rigid portion has a shore hardness of 25 D-80 D, a stretch factor of 1.04-1.15 and a tensile strength of 90 MPa-200 Mpa.

Further, preferably, the curing material is one or more of a thermocuring material, a UV curing material, a UV thermocuring material or an electron beam curing material.

Further, preferably, a concave inner surface of the nail tip layer is coated with a base adhesive.

Further, preferably, the nail tip layer is of a multi-layer structure, and the curing material is located in one or more layers of the multi-layer structure.

Further, preferably, the decorative nail tip further comprises a rigid support piece, the support piece is provided with a support block shaped like the nail, and a convex outer surface of the support block matches and is connected to a concave inner surface of the nail tip layer.

Further, preferably, the nail tip layer further comprises a rigid nail tip portion, which is disposed at an end, away from the flexible portion, of the rigid portion and is curved in a same direction as the rigid portion, and a thickness of the nail tip portion is not less than that of the rigid portion.

Further, preferably, a rigid sandwich layer is disposed in the nail tip portion, and the sandwich layer is shaped like a hollow mesh and is curved in a same direction as the nail tip portion.

In a second aspect, the application further provides a decorative nail tip manufacturing system used for manufacturing the decorative nail tip according to any one of the above-mentioned technical solutions. Specifically, the decorative nail tip manufacturing system comprises:

- A sheet forming device used for obtaining a flat sheet shaped like a nail, the sheet being flexible and stretchable, and raw materials of the sheet comprising a curing material;
- A sheet bending device used for bending the flat sheet to form a flexible nail tip layer, a convex outer surface of the flexible nail tip layer being a decorative surface with a same curve as a surface of the nail; and
- A bend curing device used for curing an end of the flexible nail tip layer, a cured portion of the nail tip layer forming a rigid portion, and a non-cured portion of the nail tip layer forming a soft and stretchable flexible portion.

In a third aspect, the application further provides a decorative nail tip manufacturing method used for manufacturing the decorative nail tip according to any one of the above-mentioned technical solutions. Specifically, the decorative nail tip manufacturing method comprises:

- S1: forming a flat sheet shaped like a nail, the sheet being flexible and stretchable, and raw materials of the sheet comprising a curing material;
- S2: bending the flat sheet to form a flexible nail tip layer, a convex outer surface of the convex outer surface being a decorative surface with a same curve as a surface of the nail;
- S3: curing an end of the soft nail tip layer, the cured end of the nail tip layer forming a rigid portion, and a non-cured end of the nail tip layer forming a soft and stretchable flexible portion.

Compared with the prior art, the decorative nail tip and the manufacturing system and method thereof provided by the invention have the following beneficial effects:

1. In this application, the portion, corresponding to the middle and fingertip of the nail, of the decorative nail tip is curved and rigid, and the portion, corresponding to the rear edge and two sides of the nail, of the decorative nail tip is flexible, that is, the decorative nail tip can flexibly fit the nail and can fulfill an orientation function; during use, the decorative nail tip can fit the edge of the nail by means of its flexibility, so the possibility of stretching, folds, air holes, hollows and edge warping is reduced; the decorative nail tip can be cured to be rigid so as to decorate the nail in a rigid and plump state, and the aesthetics is good.

2. The edge, corresponding to the rear edge and two sides of the nail, of the decorative nail tip provided by this application is thin and good in ductility, so the decorative nail tip can better fit and be adhered to the nail, and folds and edge warping are further reduced.
3. The curing material, corresponding to the rear edge and two sides of the nail, of the decorative nail tip is small in amount and hardness, such that the nail tip layer can be removed from the edge; the curing material, corresponding to the middle and fingertip of the nail, of the decorative nail tip is large in amount and hardness, and thus can be kept stable when applied to the nail and is unlikely to skew or fracture under the action of external force.
4. Through the manufacturing system and method of the decorative nail tip, the decorative nail tip which is flexible to fit the nail and rigid to fulfill an orientation function can be manufactured; the system and process are reasonable and high in efficiency, and the production efficiency is high while user requirements are met.

DESCRIPTION OF REFERENCE SIGNS

L, nail tip direction; 1, nail; 1*a*, rear edge; 1*b*, side edge; 1*c*, fingertip; 2, nail tip layer; 21, flexible portion; 22, rigid portion; 23, nail tip portion; 24, sandwich layer; 2*a*, bottom sealing layer; 2*b*, pattern layer; 2*c*, special effect layer; 2*d*, curing layer; 2*e*, top sealing layer; 2*f*, protective film; 3, base adhesive; 4, support piece; 41, support block; 5, sheet forming device; 6, sheet bending device; 7, bend curing device.

DETAILED DESCRIPTION OF THE INVENTION

The technical solutions of the embodiments of the application will be described below in conjunction with the drawings.

It should be understood that specific examples in this specification are merely for assisting those skilled in the art in better understanding the embodiments of the application, and are not intended to limit the scope of the embodiments of the application.

It should also be understood that the serial numbers of processes in the embodiments of the application do not indicate the execution order of these processes, and the execution order of these processes should be determined by their functions and internal logic, and should not limit the implementation process of the embodiments of the application in any form.

It should also be understood that the embodiments described in this specification may be implemented separately or in combination, and the application has no limitation in this aspect.

Unless otherwise stated, all technical and scientific terms used in the embodiments of the application have the same meanings as those commonly understood by those skilled in the art. The terms used in this application are merely for the purpose of describing specific embodiments, and are not intended to limit the scope of the application. The term "and/or" used in this application comprises any one and all combinations of one or more relevant items listed.

Embodiment 1

Figure 1:
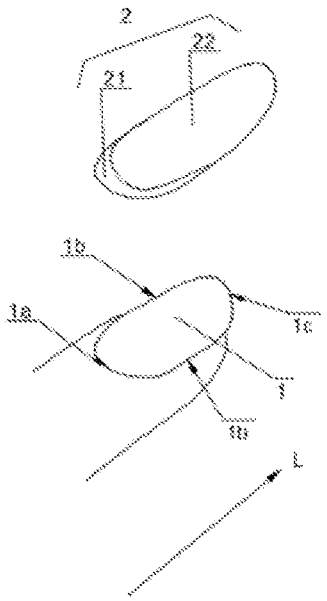
FIG. 1 is a structural view of a nail tip layer of a decorative nail tip in Embodiment 1.

Embodiment 1 of this application provides a decorative nail tip. Specifically, as shown in FIG. 1, the decorative nail tip comprises a nail tip layer 2, wherein the nail tip layer 2 is curved inwards and is similar to a human nail 1 in shape and size, a concave inner surface, namely inner surface, of the nail tip layer 2 is adhered to an outer surface of a human fingernail or toenail (collectively referred to as "nail 1" hereinafter), and a concave outer surface, namely outer surface, of the nail tip layer 2 forms a decorative surface of the nail tip layer 2 and is used for decorating the nail 1.

A nail tip direction L of the nail tip layer 2 is defined as a direction towards a fingertip 1*c* of the nail 1*b* when the nail tip layer 2 is applied to the surface of the nail 1, that is, the nail tip direction L of the nail tip layer 2 is identical with the growth direction of the nail 1. The nail tip layer 2 comprises a flexible portion 21 and a rigid portion 22, wherein the flexible portion 21 and the rigid portion 22 are arranged in the nail tip direction L; and when the nail tip layer 2 is applied to the surface of the nail 1, the flexible portion 21 fits a rear edge 1*a* and at least part of a side edge 1*b* of the nail 1, and the rigid portion 22 fits the fingertip 1*c* of the nail 1 or stretches out of the fingertip 1*c*. An outer surface of the flexible portion 21 and an outer surface of the rigid portion 22 are in smooth transition to form the decorative surface, so the outer surface of the nail tip layer 2 looks smooth and plump when the nail tip layer 2 is applied to the surface of the nail 1.

Here, the smooth transition refers to that there is no step at the joint of the outer surface the flexible portion 21 and the rigid portion 22, and the joint of the outer surface of the flexible portion 21 and the rigid portion 22 is smooth.

Particularly, in this embodiment, raw materials of the nail tip layer 2 comprise a curing material; before use, the curing material in the flexible portion 21 is not cured, thus being flexible and stretchable, and the curing material in the rigid portion 22 has been cured, thus being rigid.

Compared with the prior art, the decorative nail tip in this embodiment has a flexible end and a rigid end, so the decorative nail tip can fit nails and has an orientation function. The shape formed when the nail tip layer 2 is adhered to the nail 1 is similar to the shape of the nail 1 which grows naturally and the shape of fake nails which are sold on the market, so the entire nail tip layer 2 has the structural features of being plump, natural and aesthetic.

Specifically, when the decorative nail tip provided by this application is applied to the surface of the nail 1, the soft flexible portion 21 with good flexibility and ductility can adapt to the curved shape of the rear edge 1*a* of the nail 1 to be adhered to the nail 1, and the nail tip layer 2 can better fit the rear edge 1*a* and side edge 1*b* of the nail 1, so folds, hollows and edge seams of the flexible portion 21 of the nail tip layer 2 are reduced, and the flexible portion 21 can be fixed to the rear edge 1*a* of the nail 1 in a plump and smooth state. Then, the flexible portion 21 is cured; after being cured, the flexible portion 21 which has been applied to the rear edge 1*a* and side edge 1*b* of the nail 1 still fits the nail 1, and the possibility of air holes, hollows and edge warping between the cured rigid nail tip layer 2 and the nail 1 is reduced; the flexible portion 21 is firmly connected to the nail 1 and is unlikely to warp from the edge or even fall from the nail 1, and the possibility that dirt is accumulated between the flexible portion 21 and the nail 1 or hair is hooked by the flexible portion 21 is reduced. The flexible portion 21 of the nail tip layer 2 can completely fit the rear edge 1*a* and side edge 1*b* of the nail 1, such that the thickness of an adhesive layer required for adhering the nail tip layer 2 to the surface of the nail 1 is decreased, the breathability of the surface of the nail 1 is improved, and the use of adhesive materials in the adhesive layer and damage of the adhesive materials in the adhesive layer to nail 1 are reduced.

In addition, when the decorative nail tip in this application is applied to the surface of the nail 1, the rigid portion 22 can be accurately aligned with and fit the curve of the surface of the nail 1 by means of its rigid convex curve, such that users can easily adhere the decorative nail tip to the surface of the nail 1, and the steps of using the decorative nail tip are simplified. The rigid portion 2 forms the nail tip of the nail tip layer 2 by means of its fixed form and hardness, such that the smooth, regular and aesthetic fingertip 1*c* can be obtained without trimming and polishing the edge of the nail 1 or the nail tip layer 2, the steps of using the nail tip layer 2 are simplified, and the time for adhering the nail tip layer 2 is shortened. Meanwhile, the nail tip layer 2 can hide and protect the fingertip 1*c* by means of the rigid portion 11, such that the nail 1 is prevented from being exposed to air and will not be bent, fractured or split under the action of external force.

Moreover, in some embodiments of this application, the length of the nail tip layer 2 is greater than that of the nail 1, such that the rigid portion 22 can stretch out of the fingertip 1*c* in a rigid form after being adhered to the surface of the nail 1, thus extending the nail 1, improving the nail shape and decorating the nail surface. Compared with an existing nail tip layer 2, the nail tip layer 2 in this application can also enlarge the area of the nail surface and expand the design space of the nail tip, which allows designers to perform more diversified creations and designs on the surface of the nail tip.

Figure 2:
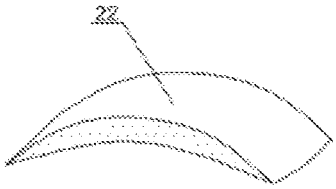
FIG. 2 is a cross-sectional structural view of the nail tip layer of the decorative nail tip in Embodiment 1.

Further, referring to FIG. 2, the thickness of the flexible portion 21 connected to the rigid portion 22 decrease gradually towards an edge of the flexible portion 21 not connected to the rigid portion 22. The edge of the flexible portion 21 not connected to the rigid portion 22 has a small thickness, that is, the joint of the flexible portion 21 and the rear edge 1*a* and side edge 1*b* of the nail 1 is thin, such that the flexibility of the flexible portion 21 can be improved, the flexible portion 21 has better flexibility and ductility and can be stretched to be adhered to the rear edge 1*a* and side edge 1*b* of the nail 1, and folds, air holes or edge warping is further reduced. The joint of the flexible portion 21 and the rear edge 1*a* and side edge 1*b* of the nail 1 is thin, so seams between the edge of the flexible portion 21 and the rear edge 1*a*, side edge 1*b* and fingertip 1*c* of the nail 1 are reduced, dirt accumulation is reduced, and hair is prevented from being hooked. In addition, the nail tip layer 2 become thinner from the middle to the edge, such that when the nail tip layer 2 is adhered to the surface of the nail 1, the rear edge 1*a* and side edge 1*b* of the nail 1 are thin, the middle of the nail 1 is plump and thick, and thus, the aesthetics and glossiness of the nail tip layer 2 applied to the surface of the nail 1 are improved.

Preferably, the thickness of the edge of the flexible portion 21 connected to the rigid portion 22 and the thickness of the rigid portion 2 are 0.05-2 mm, and the thickness of the edge of the flexible portion 21 not connected to the rigid portion 22 is 0.01-0.25 mm. In this way, the color and pattern at the joint of the flexible portion 21 and the rear edge 1*a* and side edge 1*b* of the nail 1 can be presented, and the flexible portion 21 can be flexible, tough and ductile enough to fit the curved surface of the nail 1, and the possibility of folds, air holes and edge warping is reduced.

Further, the flexible portion 21 encircles an edge of the rigid portion 22 in a U-shape, and a bottom of the U-shaped flexible portion 21 corresponds to a rear edge 1*a* of the nail 1. In this way, two side walls of the U-shaped flexible portion 21 correspond to the two side edges 1*b* of the nail 1, and thus can be easily adhered to the nail 1; and the one end of the rigid portion 22 is slightly sharp and stretches into a U-slot of the flexible portion 21. When the decorative nail tip is used, the rigid portion 22 is adhered to a large area of the surface of the nail 1, such that the structural strength of the whole nail tip layer 2 adhered to the surface of the nail 1 can be improved when the flexible portion 21 is cured and becomes rigid. The area for adhering and fixing the flexible portion 21 to the surface of the nail 1 is not limited as long as there is no fold or edge warping after the edge of the flexible portion 21 is adhered to the rear edge 1*a* and side edge 1*b* of the nail 1, and the problems of decorative nail tips in the prior art are solved.

The width of the U-shaped flexible portion 21 is 0.1-5 mm. More preferably, the width of the U-shaped flexible portion 21 is 1-2 mm. The flexible portion 21 has a small width, which facilitates the use of the nail tip layer 2 and ensures that the edge of the nail tip layer 2 can be flexibly adhered and fixed to the surface of the nail tip 1.

Further, the content of the curing material in the raw materials of the edge of the flexible portion 21 not connected to the rigid portion 22 is lower than the content of the curing material in the raw materials of the edge of the flexible portion connected to the rigid portion 22. More particularly, the content of the curing material in the flexible portion 21 increases gradually from the edge of the flexible portion 21 not connected to the rigid portion 22 to the edge of the flexible portion 21 connected to the rigid portion 22. In this way, when the nail tip layer 2 is adhered to the surface of the nail 1 and the curing material in the flexible portion 21 is cured to fix the nail tip layer 2 to the surface of the nail 1 in a rigid state, the rigidity of the middle of the nail tip layer 2 is larger, and the nail tip layer 2 in the rigid state is unlikely to skew, deform or crack under the action of external force. The rigidity of the edge of the nail tip layer 2 is small, such that the nail tip layer 2 can warp from the edge when removed. In addition, before the flexible portion 21 is cured, the rigidity of the flexible portion 21 and the rigid portion 22 increases gradually to realize gentle transition, such that when the entire nail tip layer 2 is pulled, the nail tip layer 2 can deform and retreat uniformly, and the cured nail tip layer 2 is plump, glossy and high in toughness.

Not limited to one curing material or one curing method, the curing material in this embodiment may be one or more of a thermocuring material, a UV curing material, a UV thermocuring material or an electron beam curing material.

Moreover, the raw materials further comprise a solvent and an initiator corresponding to the type of the curing material, and the initiator is activated under a certain condition to stimulate the curing material to be subjected to a curing reaction to be hardened on the whole.

In this embodiment, before being cured, the flexible portion 21 has a shore hardness of 20 A-60 A, a stretch factor of 1.5-5, and a tensile strength of 80 MPa-500 Mpa. In other embodiments of this application, before being cured, the flexible portion 21 has a shore hardness of 25 A-45 A, a stretch factor of 3-4, and a tensile strength of 300 MPa-400 Mpa.

After being cured, the flexible portion 21 has a shore hardness of 20 D-70 D, a stretch factor of 1.05-1.2, and a tensile strength of 100 MPa-200 Mpa. In other embodiments of this application, after being cured, the flexible portion 21 has a shore hardness of 30 D-50 D, a stretch factor of 1.1-1.3, and a tensile strength of 125 MPa-150 Mpa.

The rigid portion 22 has a shore hardness of 25 D-80 D, a stretch factor of 1.04-1.15, and a tensile strength of 90 Mpa-200 Mpa. In other embodiments of this application, the rigid portion 22 has a shore hardness of 40 D-60 D, a stretch factor of 1.1-1.12, and a tensile strength of 120 Mpa-150 Mpa.

In this way, before being cured, the flexible portion 21 has the properties of good flexibility and ductility, and can be tightly adhered to the curved nail 1, so folds are reduced, and the flexible portion 21 is unlikely to deform or fracture when pulled. After being cured, the flexible portion 21 has high hardness and small ductility, which are similar to the properties of the rigid portion 22, and can be applied to the surface of the nail 1 in a rigid and plump state like a gem to fulfill a decorating effect.

Figure 3:
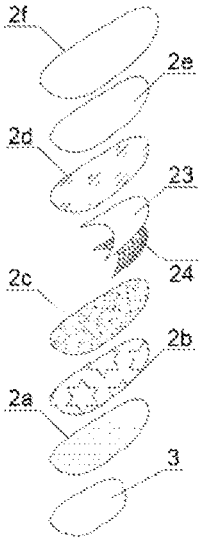
FIG. 3 is a schematic diagram of a layer structure of the nail tip layer of the decorative nail tip in Embodiment 1.

As shown in FIG. 3, to facilitate the use of the nail tip layer 2, the concave inner surface of the nail tip layer 2 is coated with a base adhesive 3, and the nail tip layer 2 can be adhered to the nail 1 directly with the base adhesive 3. In case of no base adhesive 3, the nail tip layer 2 may be adhered to the surface of the nail 1 with liquid glue, solid glue or jelly glue.

Corresponding to a short nail tip layer 2, the whole bottom of the nail tip layer 2 is coated with the base adhesive. Corresponding to a long nail tip layer 2, the base adhesive 3 is located at an end, close to the flexible portion 21, of the bottom of the nail tip layer 2 in the shape of the nail 1.

The nail tip layer 2 is of a multi-layer structure, and the curing material is located in one or more layers of the multi-layer structure. Different from an existing nail tip layer 2 which is of a one-layer structure formed by injection molding of raw materials after the raw materials are mixed, the nail tip layer 2 of the multi-layer structure has a better sense of layering, the color and pattern of the nail tip layer 2 can be better reflected, and the structure of the nail tip layer 2 can be designed and improved in the layer structure. The multi-layer structure can improve the connection strength between the flexible portion 21 and the rigid portion 22 and reduce the possibility of breakage of the joint of the flexible portion 21 and the rigid portion 22 caused by different hardening times of the flexible portion 21 and the rigid portion 22.

Particularly, referring to FIG. 3, the nail tip layer 2 comprises a bottom sealing layer 2*a*, a pattern layer 2*d*, a special effect layer 2*c*, a curing layer 2*d* and a top sealing layer 2*e* from the concave inner surface to the convex outer surface, wherein the curing material is located in the curing layer 2*d*; the bottom sealing layer 2*d* functions as a bottom support layer and is preferably made of acrylic acid, polyurethane, polyester and epoxy resin; the pattern layer 2*b* is printed on an isolating layer and may be made through screen printing, offset printing, digital printing, flexographic printing, relief printing or the like; the special effect layer 2*c* is designed according to an effect required by the decorative nail tip, is made of glitter powder, pearl powder, auroral powder, fluorescent powder, temperature-variable powder, hot gold foil or the like, and has a colorful and bright visual effect through screen printing, hot stamping, spreading, spraying or the like. Raw materials of the curing layer 2*d* comprise UV curing resin, a photoinitiator and an environmentally friendly solvent. The curing layer 2*d* is liquid at normal temperature, is subjected to a thermosetting reaction after the solvent is heated to evaporated, and is in a semi-solid emulsion state after being cooled, and at this moment, the curing layer 2*d* has good flexibility and adhesion. When the curing layer 2*d* is irradiated with a UV light, the photoinitiator will be activated, and the curing layer 2*d* will be subjected to a photocuring effect to be hardened and shaped rapidly.

Particularly, the nail tip layer 2 further comprises a nail tip portion 23, which is disposed at an end, away from the flexible portion 21, of the rigid portion 22 and is curved in a same direction as the rigid portion 22, and the thickness of the nail tip portion 23 is not less than that of the rigid portion 22. Particularly, as shown in FIG. 3, the nail tip portion 23 is located between the special effect layer 2*c* and the curing layer 2*d*, and the thickness of the nail tip layer 2 increases gradually from the rigid portion 22 to the nail tip portion 23.

To improve the tenacity and strength of the nail tip portion 23 under the condition of guaranteeing the hardness, as shown in FIG. 3, a rigid sandwich layer 24 is disposed in the nail tip portion 23, and the sandwich layer 24 is shaped like a hollow mesh and is curved in the same direction as the nail tip portion 23. The sandwich layer 24 may be made of plastic, resin or metal.

To protect the nail tip layer 2 against dirt, deformation and various imprints before being used by users, a protective film 2*f* is disposed on the surface of the nail tip layer 2, and the area of the protective film 2*f* is greater than that of the nail tip layer 2, such that the entire nail tip layer 2 can be covered by the protective film 2*f*.

Figure 4:
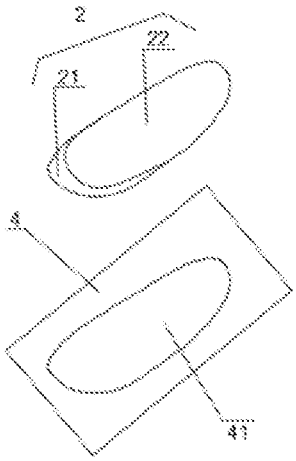
FIG. 4 is a structural view of a decorative nail tip with a support piece in Embodiment 2.

Particularly, to maintain the curved contour, similar to that of the nail 1, of the nail tip layer 2, the flexible portion 21 of the nail tip layer 2 is made to keep a curved state under the action of an external object, and the outer surface of the flexible portion 21 and the outer surface of the rigid portion 22 look like smooth and plump curved surfaces in appearance. In this embodiment, as shown in FIG. 4, the external object is a support piece 4, which is in a rigid state and is provided with a support block 41 shaped like the nail 1, and a convex outer surface of the support block 41 matches and is connected to the concave inner surface of the nail tip layer 2. In this way, the support block 41 can support the rigid portion 22, the possibility of skewing, deformation and even fracture of the rigid portion 22 under the action of external force is reduced, and the flexible portion 21 and the joint of the flexible portion 21 and the rigid portion 22 are shaped and supported, so folds will not be generated on the flexible portion 21 or at the joint of the flexible portion 21 and the rigid portion 22, which may otherwise compromise the aesthetics of the nail tip layer 2. Moreover, the arched support block 41 shaped like the nail 1 has a high support capacity, and matches and is connected to the concave inner surface of the nail tip layer 2, thus compared with support blocks 41 in other shapes, having a better support effect.

Embodiment 2

Embodiment 2 of this application provides a decorative nail tip manufacturing system, which is used for manufacturing the decorative nail tip in Embodiment 1. The actual process or structure of Embodiment 2 is similar to and also different from that of Embodiment 1. The differences of Embodiment 2 from Embodiment 2 will be described below, and details that are not described below should be regarded as identical with those in Embodiment 1.

Figure 5:
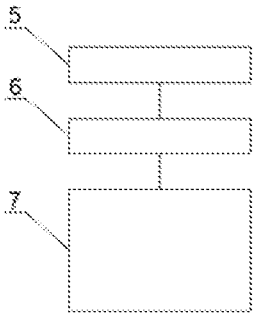
FIG. 5 is a schematic diagram of a decorative nail tip manufacturing system in Embodiment 2.

In Embodiment 2, as shown in FIG. 5, the decorative nail tip manufacturing system comprises a sheet forming device 5, a sheet bending device 6 and a bend curing device 7 which are connected in sequence. Wherein, the sheet forming device 5 is used for obtaining a flat sheet shaped like a nail 1, the sheet is flexible and stretchable, and raw materials of the sheet comprise a curing material; the sheet bending device 6 is used for bending the flat sheet, and a convex outer surface of the sheet is a decorative surface which has a same curve as the surface of the nail 1; and the bend curing device 7 is used for curing one end of the bent sheet to make the end of the bent sheet in a rigid state.

Compared with the prior art, the decorative nail tip manufacturing system provided by this embodiment has the following beneficial effects: through the linkage of different devices, raw materials are processed in these devices to form a flat sheet, bend the sheet and cure a nail tip layer 2 so as to obtain the nail tip layer 2 with a flexible end and a rigid end, such that the process is simple, and operation is convenient. As described in Embodiment 1, the nail tip layer 2 with one flexible end and one rigid end can be flexibly adhered to the rear edge 1*a* and side edge 1*b* of the nail 1, so folds and warping of the edges can be reduced; and the nail tip layer 2 can also be applied to or stretch out of the fingertip 1*c* in a rigid state to beautify the fingertip 1*c*, and the fingertip 1*c* does not need to be polished. The nail tip layer 2 is high in use efficiency and good in user experience.

Particularly, the sheet forming device 5 may be one of a screen printer, a lithographic offset press, a digital printer, a flexographic press, an intaglio press and a relief press, such that the flat sheet is formed through screen printing, lithographic offset printing, digital printing, flexographic printing, intaglio printing or relief printing by means of the corresponding devices.

Embodiment 3

Embodiment 3 of this application provides a decorative nail tip manufacturing method, which is used for manufacturing the decorative nail tip in Embodiment 1 through the decorative nail tip manufacturing system in Embodiment 2. The actual process or structure of Embodiment 3 is similar to and also different from that of Embodiment 1 and Embodiment 2. The differences of Embodiment 3 from Embodiment 1 and Embodiment 2 will be described below, and details that are not described below should be regarded as identical with those in Embodiment 1 and Embodiment 2.

Figure 6:
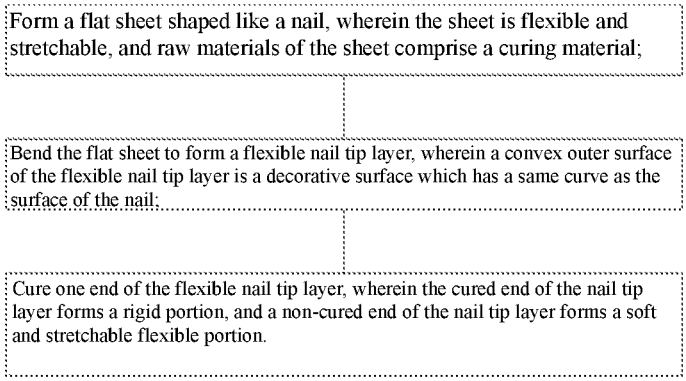
FIG. 6 is a flow diagram of a decorative nail tip manufacturing method in Embodiment 3.

In Embodiment 3, as shown in FIG. 6, the decorative nail tip manufacturing method comprises the following steps:

S1: a flat sheet shaped like a nail 1 is formed, wherein the sheet is flexible and stretchable, and raw materials of the sheet comprise a curing material;

S2: the flat sheet is bent to form a flexible nail tip layer 2, wherein a convex outer surface of the flexible nail tip layer 2 is a decorative surface which has a same curve as the surface of the nail 1; and S3: one end of the flexible nail tip layer 2 is cured, wherein the cured end of the nail tip layer 2 forms a rigid portion 22, and a non-cured end of the nail tip layer 2 forms a soft and stretchable flexible portion 21.

According to the decorative nail tip manufacturing method provided by this embodiment, raw materials are processed through different steps to form a flat sheet, bend the sheet and cure the nail tip layer 2 so as to obtain the nail tip layer 2 with a flexible end and a rigid end, such that the process is simple, and operation is convenient. As described in Embodiment 1, the nail tip layer 2 with one flexible end and one rigid end can be flexibly adhered to the rear edge 1*a* and side edge 1*b* of the nail 1, so folds and warping of the edges can be reduced; and the nail tip layer 2 can also be applied to or stretch out of the fingertip 1*c* in a rigid state to beautify the fingertip 1*c*, and the fingertip 1*c* does not need to be polished. The nail tip layer 2 is high in use efficiency and good in user experience.

In S1, the sheet shaped like the nail is formed through the sheet forming device 5, and specifically, the flat sheet is formed through screen printing, lithographic offset printing, digital printing, flexographic printing, intaglio printing or relief printing by means of a screen printer, a lithographic offset press, a digital printer, a flexographic press, an intaglio press or a relief press.

It should be understood that the above embodiments can be implemented in different forms, and the scope of the claims should not be interpreted as limiting the embodiments of the application. To be more specific, these embodiments are provided to make the disclosure be understood fully and comprehensively and sufficiently convey the concept of the embodiments of the invention to those skilled in the art. The disclosure actually aims to include all alternative solutions, amendments and equivalent solutions of embodiments based on the spirit and scope of the disclosure defined by the appended claims. In addition, for the sake of a full understanding, a large quantity of details will be expounded in the detailed description of the embodiments of the disclosure. It is obvious for those ordinarily skilled in the art that the embodiments of the disclosure can be implemented without these specific details.

What is claimed is:

1. A decorative nail tip, comprising a nail tip layer shaped like a nail, a convex outer surface of the nail tip layer being a decorative layer, wherein the nail tip layer comprises a flexible portion and a rigid portion which are sequentially arranged in a nail tip direction, an outer surface of the flexible portion and an outer surface of the rigid portion are in smooth transition to form the decorative layer, wherein the flexible portion encircles an edge of the ridge portion in a U-shape, raw materials of the nail tip layer comprise a curing material, the curing material in the flexible portion is not cured, thus being flexible and stretchable, and the curing material in the rigid portion is cured, thus being rigid.

2. The decorative nail tip according to claim 1, wherein a thickness of the flexible portion connected to the rigid portion decreases gradually towards an edge of the flexible portion not connected to the rigid portion.

3. The decorative nail tip according to claim 1, wherein a content of the curing material in the raw materials of an edge of the flexible portion not connected to the rigid portion is lower than a content of the curing material in the raw materials of an edge of the flexible portion connected to the rigid portion.

4. The decorative nail tip according to claim 1, wherein before being cured, the flexible portion has a shore hardness of 20 A-60 A, a stretch factor of 1.50-5.00 and a tensile strength of 80 MPa-500 Mpa;

after being cured, the flexible portion has a shore hardness of 20 D-70 D, a stretch factor of 1.05-1.20 and a tensile strength of 100 MPa-200 Mpa;

the rigid portion has a shore hardness of 25 D-80 D, a stretch factor of 1.04-1.15 and a tensile strength of 90 MPa-200 Mpa.

5. The decorative nail tip according to claim 1, wherein a concave inner surface of the nail tip layer is coated with a base adhesive.

6. The decorative nail tip according to claim 1, wherein the nail tip layer is of a multi-layer structure, and the curing material is located in one or more layers of the multi-layer structure.

7. The decorative nail tip according to claim 1, wherein the decorative nail tip further comprises a rigid support piece, the support piece is provided with a support block shaped like the nail, and a convex outer surface of the support block matches and is connected to a concave inner surface of the nail tip layer.

8. The decorative nail tip according to claim 1, wherein the nail tip layer further comprises a rigid nail tip portion, which is disposed at an end, away from the flexible portion, of the rigid portion and is curved in a same direction as the rigid portion, and a thickness of the rigid nail tip portion is not less than a thickness of the rigid portion.

9. The decorative nail tip according to claim 8, wherein a rigid sandwich layer is disposed in the rigid nail tip portion, and the sandwich layer is shaped like a hollow mesh and is curved in a same direction as the rigid nail tip portion.

10. A decorative nail tip manufacturing system for manufacturing the decorative nail tip according to claim 1, comprising:

a sheet forming device used for obtaining a flat sheet shaped like a nail, the flat sheet being flexible and stretchable, and raw materials of the flat sheet comprising a curing material;

a sheet bending device used for bending the flat sheet to form a flexible nail tip layer, a convex outer surface of the flexible nail tip layer being a decorative surface with a same curve as a surface of the nail; and a bend curing device used for curing an end of the flexible nail tip layer, a cured portion of the flexible nail tip layer forming a rigid portion, and a non-cured portion of the flexible nail tip layer forming a soft and stretchable flexible portion.

11. A decorative nail tip manufacturing method for manufacturing the decorative nail tip according to claim 1, comprising:

S1: forming a flat sheet shaped like a nail, the flat sheet being flexible and stretchable, and raw materials of the flat sheet comprising a curing material;

S2: bending the flat sheet to form a flexible nail tip layer, a convex outer surface of the flexible nail tip layer being a decorative surface with a same curve as a surface of the nail; and S3: curing an end of the flexible nail tip layer, the cured end of the flexible nail tip layer forming a rigid portion, and a non-cured end of the flexible nail tip layer forming a soft and stretchable flexible portion.

12. The decorative nail tip according to claim 1, wherein a width of the U-shaped flexible portion ranges from 1 mm to 2 mm.

13. The decorative nail tip according to claim 1, wherein the flexible portion encircles the edge of the rigid portion in the U-shape in a top view of the nail tip layer.

14. The decorative nail tip according to claim 8, wherein a thickness of the nail tip layer increases gradually from the rigid portion to the rigid nail tip portion.

15. The decorative nail tip according to claim 1, wherein the nail tip layer includes a bottom sealing layer, a pattern layer, a special effect layer, a curing layer, and a top sealing layer arranged from a concave inner surface of the nail tip layer to the convex outer surface of the nail tip layer.

16. The decorative nail tip according to claim 15, wherein a protective film is disposed on the convex outer surface of the nail tip layer, and an area of the protective film is greater than an area of the nail tip layer such that an entirety of the nail tip layer is covered by the protective film.

17. The decorative nail tip according to claim 15, wherein the nail tip layer further comprises a rigid nail tip portion, the rigid nail tip portion is located between the special effect layer and the curing layer.

18. The decorative nail tip according to claim 15, wherein the curing material is located in the curing layer, the bottom sealing layer is configured as a bottom support layer, and the pattern layer is printed on an isolating layer.

19. The decorative nail tip according to claim 1, wherein one end of the rigid portion is sharp and stretches into a U-slot of the flexible portion.

* * * * *